US006963026B2

(12) United States Patent
Brennan

(10) Patent No.: US 6,963,026 B2
(45) Date of Patent: Nov. 8, 2005

(54) GROUND ROD

(76) Inventor: Bob Brennan, 6765 Towering Ridge Way, Apt. 209, Cincinnati, OH (US) 45247

( * ) Notice: Subject to any disclaimer, the term of this patent is extended or adjusted under 35 U.S.C. 154(b) by 0 days.

(21) Appl. No.: 10/770,434

(22) Filed: Feb. 3, 2004

(65) Prior Publication Data

US 2004/0154814 A1 Aug. 12, 2004

Related U.S. Application Data

(60) Provisional application No. 60/445,955, filed on Feb. 7, 2003.

(51) Int. Cl.[7] ..... H01R 4/66
(52) U.S. Cl. ..... 174/7; 174/3; 174/6; 81/177.85
(58) Field of Search ..... 174/3, 5 R, 5 SG, 174/6, 7; 361/216, 222; 403/305–307; 81/52, 81/53.1, 177.85, 488, 489

(56) References Cited

U.S. PATENT DOCUMENTS 501,811 A * 7/1893 Stombaugh ..... 174/7
2,065,184 A * 12/1936 Heinrich ..... 174/7
2,270,325 A * 1/1942 Matthews ..... 174/7
2,449,313 A * 9/1948 Naef ..... 174/6
4,577,053 A * 3/1986 Kies ..... 174/7
4,626,330 A * 12/1986 Farmer ..... 174/7
4,688,969 A * 8/1987 Bruser et al. ..... 174/7
5,438,894 A * 8/1995 Pearce ..... 81/177.2
5,568,757 A * 10/1996 Lewis ..... 81/177.2
6,040,522 A * 3/2000 Beggs ..... 174/7
6,193,443 B1 * 2/2001 Trudeau et al. ..... 405/252
6,677,517 B2 * 1/2004 Fowler et al. ..... 174/3
6,874,392 B1 * 4/2005 Wu ..... 81/177.85
2003/0192713 A1 * 10/2003 Orsini et al. ..... 174/7

* cited by examiner

*Primary Examiner*—Dean A. Reichard
*Assistant Examiner*—Adolfo Nino
(74) *Attorney, Agent, or Firm*—Wood, Herron & Evans, L.L.P.

(57) ABSTRACT

A ground rod includes first and second ends connected by a shaft portion. The first end has an auger configuration permitting it to be drilled into the ground. The opposite end is adapted to attached to either an electric drill or an impact wrench. This drastically reduces the time required to drive the ground rod into the ground. In an alternate embodiment, the ground rod also adapted to attach to a handle which allows it to be manually inserted or removed from the ground.

6 Claims, 2 Drawing Sheets

GROUND ROD

This application claims benefit of Provisional application Ser. No. 60/445,955, filed Feb. 7, 2003.

BACKGROUND

Ground rods are used in a variety of situations for safety. Ground rods are attached to the electrical system of a building to prevent electrical shock of equipment or individuals.

Utility workers constantly face the risk of electrocution when working with high voltage electric wires. When using a lift truck there is also the possibility that the truck will strike a hot wire. To reduce these risks, the truck should be grounded. Some locations have permanent grounds to which the truck can attach. However, in many locations there are no such grounds. Therefore, the electrical worker, in order to ensure safety, should install a temporary ground rod and connect the truck to the ground rod.

To be effective, the ground rod must be inserted a minimum distance into the ground usually about six feet. This will assure adequate contact with moist dirt and allow for conduction. To install a temporary ground rod, the utility workers would use a device as shown in FIG. 1. This is a typical removable ground rod 10 which has a permanently attached handle 11 connected to a shaft 12, in turn connected to an auger 13 or helical pointed member. The worker simply rotates the rod 10 using the handle 11 forcing it into the ground.

Because it is so difficult, utility workers tend to either not use the ground rods or not insert them far enough into the ground.

Permanent ground rods are generally just metal rods. Permanent ground rods are pounded into the ground and are connected to a building's electrical system. The electrician can use a hammer or a rod driver to force the rod into the ground. This can be difficult and time consuming.

SUMMARY OF THE INVENTION

Accordingly, it is the object of the present invention to provide a ground rod that is easy to install. Further, it is an object of the present invention to provide a ground rod which can be driven by a power tool.

The objects and advantages of the present invention are provided by a ground rod which has a head member that is adapted to connect to a rotating powered driver, such as an electric drill, impact wrench or electric threader.

In one embodiment, the present invention is a ground rod to which a handle can be temporarily attached to the head and which also provides a method for manually driving the ground rod. This is ideal for use as a temporary ground rod by utility workers.

The objects and advantages of the present invention will be further appreciated in light of the following detailed description and drawings in which:

DETAILED DESCRIPTION

Figure 1:
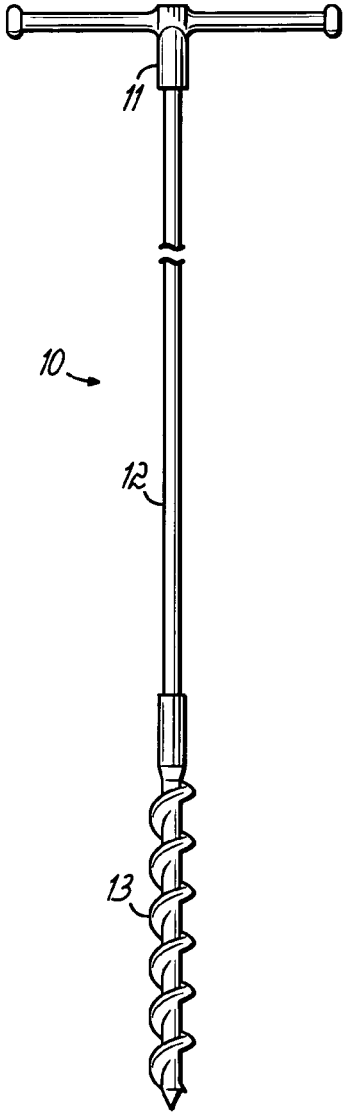
FIG. 1 PRIOR ART
FIG. 1 is a plan view of a prior art temporary ground rod.
Figure 2:
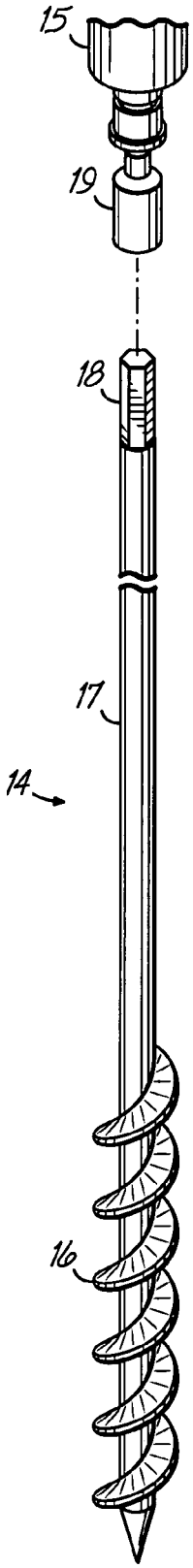
FIG. 2 is a plan view of the present invention.
Figure 4:
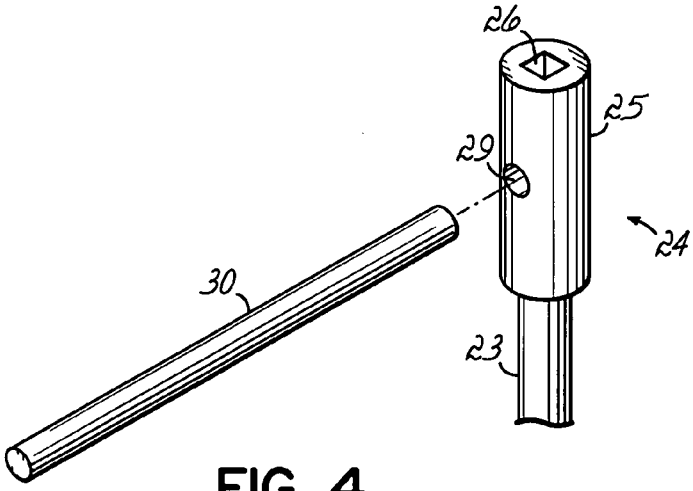
FIG. 4 is a perspective view partially exploded and partially broken away of FIG. 3.

As shown in FIG. 2, the present invention is a ground rod 14 which is adapted to be driven into the ground by an electric drill 15 or an impact wrench. The ground rod 14 includes an auger tip section 16, a shaft section 17 and a head 18 which is adapted to mate with a drill. The end 19 can be adapted to mate with an electric drill or impact srench in a number of ways. The head can simply be faceted like the end of a drill bit. This will allow the chuck of the drill bit to grasp the head. The head can be enlarged and faceted, like the head of a bolt. This will allow a socket to mate with and engage the head. The socket would be driven by a quarter, half or three quarter inch standard drive which would be held in the drill's chuck or by the impact wrench. The head can also be enlarged and have a square recess adapted to receive the socket drive directly, as shown in FIG. 4.

Generally, the ground rod 14 is made from a conductive material, in particular copper clad steel. The auger end 16 can be molded brass and can be welded to the shaft portion 17, or it may be machined, or the like. It is also possible for the shaft to be separable from the auger tip connected by, for example, inter-engaging threads. The length of the ground rod will be about 7 to 8 feet. Generally, for use in the present invention, the diameter of the shaft 17 will be about 0.5 to 1 inch. The diameter of the auger will be about ⅜ to ½ inch larger than the shaft diameter. These dimensions are adequate for grounding purposes, particularly in homes and, further, is sufficiently thin to permit use of an electric drill.

To use the ground rod of the present invention as shown, one merely places the tip 16 into the ground and attaches the drill 15 with a socket 19 to the faceted head 18. Generally, a ½-inch electric drill, impact wrench or electric threader is adequate to drive the ground rod. The drill is turned on, causing the ground rod 14 to rotate and driving it into the ground. The ground rod should be driven at least 6 feet into the ground. Conductivity tests can be done to determine if the ground rod is driven far enough into the ground. The ground rod is then attached to the ground circuit from a building electrical system with a thick copper wire, permanently grounding the electrical system for the building.

Figure 3:
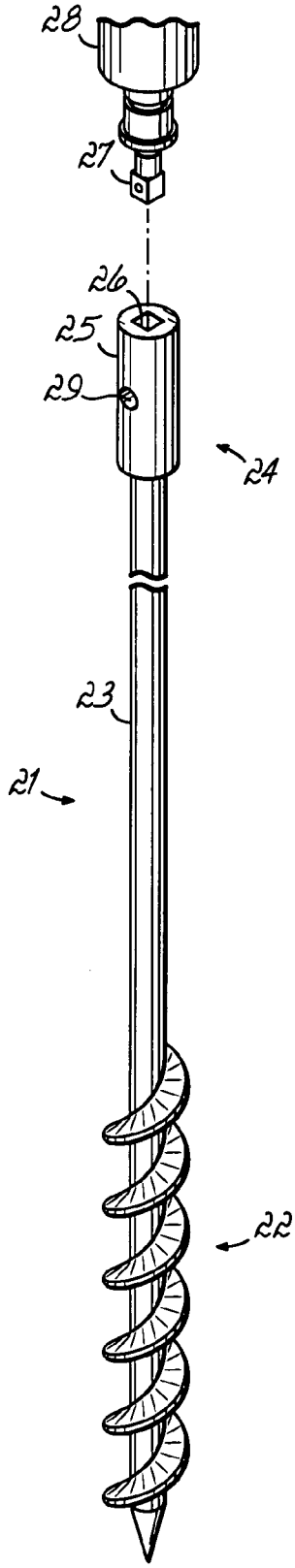
FIG. 3 is a plan view of an alternate embodiment of the present invention.

As shown in FIG. 3, an alternate embodiment of the present invention is a temporary ground rod 21 typically used by utility workers Rod 21 includes a first end 22, a shaft 23, and a second end 24. The first end 22 comprises an auger tip which typically is a cast bronze material which is strong and adapted to be driven into the ground. This is welded to a copper clad steel shaft 23 which extends from the auger up to the second end.

The second end in turn has an enlarged portion 25 which incorporates a rectangular female portion 26 adapted to receive the drive 27 of an impact wrench 28. This head portion further includes a transverse hole 29 having a size adapted to receive a rod 30 which can slide in and out of hole 29 providing a temporary handle. The enlarged head portion 25 is formed from, for example, brass or steel and is simply welded on to the shaft 23. Alternatively, the head configuration shown in FIG. 2 can be used.

Figure 5:
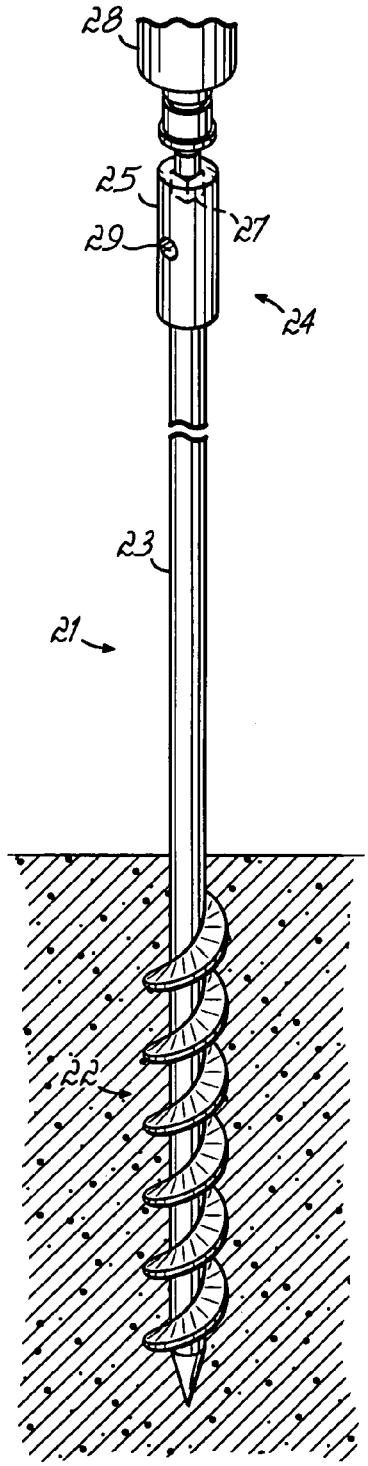
FIG. 5 is a plan view of the present invention diagrammatically depicting an impact wrench and how it attaches to the present invention.

As shown in FIG. 5, to drive the temporary ground rod 21 into the earth, one simply fixes the drive 27 of an impact wrench 28 into female member 26 and activates the impact wrench 28. This will cause the ground rod 21 to rotate. The first end 22 comprising an auger tip will dig into the ground pulling the rod with it. This will enable the utility worker to quickly insert the ground rod to a depth necessary to effect the necessary conduction through the ground rod. Once inserted, a ground wire would be attached to the utility truck through a clip (not shown) thus protecting the occupants from electrical current. To remove the rod 21, the impact wrench is simply reversed and the rod removed from the ground.

Alternately, if the ground is soft, handle 30 can be inserted into hole 29 and this can be rotated by hand to insert the ground rod into the earth in the same manner as previously described or to remove the ground rod.

Thus, the present invention allows one to quickly and easily insert a ground rod either for permanent use attached to the electrical system of a building, or for temporary use attached to electrical utilities. Further, tests conducted indicate that the ground rod of the present invention provides the same grounding effect as a straight shaft even though the ground rod of the present invention disturbs the soil as it is inserted. Thus, over time, as the soil recompacts, it is expected that the grounding efficacy of the present invention will actually exceed a standard rod.

This has been a description of the present invention along with the preferred method of practicing the present invention. However, the invention itself should only be defined by the appended claims wherein

I claim:

1. A ground rod in combination with a handle, said ground rod having a first end, a shaft portion and a second end said first end having a pointed auger portion fixed to said shaft portion;

the second end having a tip portion having means to mate with a rotating powered driver and said handle configured to attach to said second end and permit manual insertion and removal of said ground rod.

2. The ground rod claimed in claim 1 attached to an electric threader.

3. A temporary ground rod comprising a first end and a second end connected together by a shaft:

said first end comprising an auger fixed to said shaft;

the second end comprising a head portion having a configuration which connects to a wrench, thereby permitting it to be driven by a wrench; and a handle removably attachable to said head portion.

4. The ground rod claimed in claim 3 wherein said second end is faceted.

5. The ground rod claimed in claim 3 wherein said second end has a rectangular recess adapted to receive a standard drive.

6. The ground rod claimed in claim 3 wherein said ground rod includes a hole through said head portion and said handle is a rod sized to fit through said hole.

* * * * *